US008201300B2

(12) United States Patent
Cutler

(10) Patent No.: US 8,201,300 B2
(45) Date of Patent: Jun. 19, 2012

(54) CLEANING IMPLEMENT

(76) Inventor: Paul Cutler, Charleston, SC (US)

( * ) Notice: Subject to any disclaimer, the term of this patent is extended or adjusted under 35 U.S.C. 154(b) by 373 days.

(21) Appl. No.: 12/587,725

(22) Filed: Oct. 13, 2009

(65) Prior Publication Data

US 2010/0257686 A1 Oct. 14, 2010

Related U.S. Application Data

(60) Provisional application No. 61/168,076, filed on Apr. 9, 2009.

(51) Int. Cl.
*A47L 13/11* (2006.01)

(52) U.S. Cl. ..... 15/245; 15/143.1; 15/236.01

(58) Field of Classification Search ..... 15/245, 15/121, 236.1, 105, 236.05–236.09
See application file for complete search history.

(56) References Cited

U.S. PATENT DOCUMENTS

| | | | | |
|---|---|---|---|---|
| 4,097,951 | A * | 7/1978 | Hurtt | 15/245.1 |
| 5,321,868 | A * | 6/1994 | Coulson et al. | 15/245.1 |
| 5,626,683 | A * | 5/1997 | Blouin | 134/8 |
| 6,516,490 | B1 * | 2/2003 | Hatala | 15/236.02 |
| 2006/0118246 | A1 * | 6/2006 | Williams | 156/579 |
| 2007/0169299 | A1 * | 7/2007 | Stankovic | 15/236.01 |
| 2010/0236003 | A1 * | 9/2010 | Teng | 15/105 |

* cited by examiner

*Primary Examiner* — Dung Van Nguyen
(74) *Attorney, Agent, or Firm* — P. Jeff Martin; The Law Firm of P. Jeffrey Martin, LLC

(57) ABSTRACT

A cleaning implement is disclosed for effectively removing not only liquid and solid food debris from plate or dish surfaces, but also dirt and other debris accumulated on other surfaces without the use of water, thereby conserving water consumption.

13 Claims, 3 Drawing Sheets

CLEANING IMPLEMENT

RELATED APPLICATIONS

This application claims the benefit of U.S. Provisional Application No. 61/168,076 filed on Apr. 9, 2009.

BACKGROUND OF THE INVENTION

1. Field of the Invention

This application discloses and claims embodiments generally related to implements for cleaning, and more particularly, to a cleaning implement for removing debris from surfaces without the use of water.

2. Description of the Related Art

It is widely recognized that prior to washing dishes manually or placing them in a dishwasher, dishes are most often rinsed under a continuous flow of water, thereby resulting in the unnecessary waste of water. The prior art discloses many different types of implements for removing or loosening food debris stuck on dishes, such as scouring pads, brushes, and sponges. Oftentimes, food debris may comprise both liquid food debris in addition to solid debris and conventional brushes are ineffective for removing both. However, the prior art does not disclose a device for removing debris, such as food, from surfaces without the use of water.

Accordingly, a long felt has been realized for a cleaning implement for effectively removing not only liquid and solid food debris from plate or dish surfaces, but also dirt and other debris accumulated on other surfaces without the use of water so as to conserve water consumption. The development of the cleaning implement fulfills this need.

This application presents claims and embodiments that fulfill a need or needs not yet satisfied by the products, inventions and methods previously or presently available. In particular, the claims and embodiments disclosed herein describe a cleaning implement for removing debris from surfaces without the use of water, the cleaning implement comprising a first side opposing a second side; a lower blade edge from which a leading curved blade edge extends upwardly therefrom inclinationally, the leading curved blade edge terminates upwardly into a curved pinnacle edge, the curved pinnacle edge extending therefrom into an elongated curved upper edge, the elongated curved upper edge terminates into a trailing curved blade edge; a first bevel and a second bevel; and a pair of gripping sections, wherein the cleaning implement providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Therefore, it is an object of the present invention to provide a cleaning implement comprised of a squeegee blade adapted and configured for removing debris from surfaces without the use of water.

It is another object of the present invention to provide a squeegee blade constructed of a lightweight, resiliently flexible plastic material.

It is another object of the present invention to provide a squeegee blade having lower blade edge that when pressed against a surface the lower blade edge may change shape slightly according to a contour of the plate surface in view of the lower blade edge's inherent deformability such that the contours of the plate surface can be followed intimately by the lower blade edge, thereby providing exceptional cleaning.

It is another object of the present invention to provide a squeegee blade having a pair of gripping sections being ergonomically configured to facilitate and enhance the grip of the cleaning implement by a user.

It is still another object of the present invention to provide a cleaning implement which may be manufactured in any number of desired color choices.

It is yet another object of the present invention to provide a cleaning implement that may be provided with ornamentation or indicia in the form of a company or corporate name, logo, wording, picture, photograph, or any other decorative, informational, promotional or advertisement indicia.

In accordance with one embodiment of the present invention, a cleaning implement is disclosed for engaging a surface to be cleaned, such as a dish surface, and for removing unwanted material having accumulated onto the surface. The cleaning implement comprises an elongated squeegee blade made of a lightweight, resiliently flexible plastic material.

The squeegee blade comprises a first side opposite a second side and a lower blade edge from which a leading curved blade edge extends upwardly therefrom inclinationally. The leading curved blade edge terminates upwardly into a curved pinnacle edge, the curved pinnacle edge extending therefrom into an elongated curved upper edge. The elongated curved upper edge terminates into a trailing curved blade edge.

The first side and the second side of the squeegee blade each comprise a first bevel and a second bevel. The first side and the second side each further comprise a gripping section ergonomically configured to facilitate and enhance the grip of the cleaning implement by user.

The cleaning implement is envisioned to be manufactured in any number of desired color choices. In addition, the cleaning implement may be provided with ornamentation or indicia in the form of a company or corporate name, logo, wording, picture, photograph, or any other decorative, informational, promotional or advertisement indicia.

An alternate embodiment is disclosed wherein the gripping sections each includes spaced recesses, some of which being vertically oriented, arcuate-shaped, and oval-shaped.

The use of the present invention allows debris to be removed from surfaces without the use of water in a quick, easy, and efficient manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
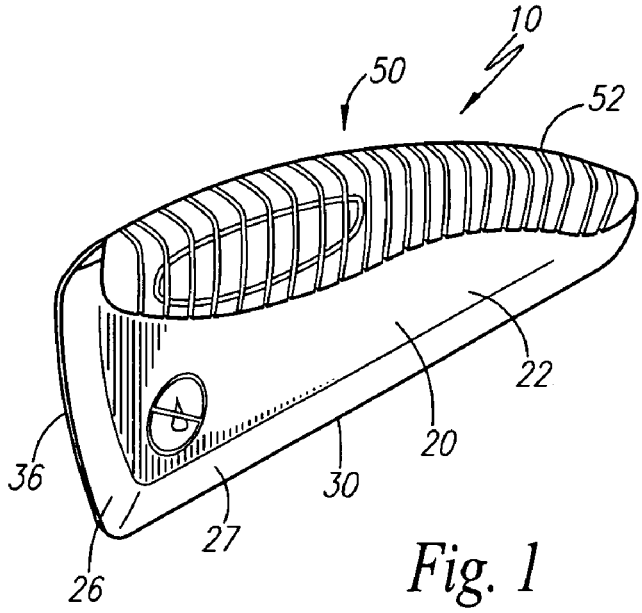
FIG. 1 is a left side perspective view of a cleaning implement, according to the preferred embodiment of the present invention.
Figure 2:
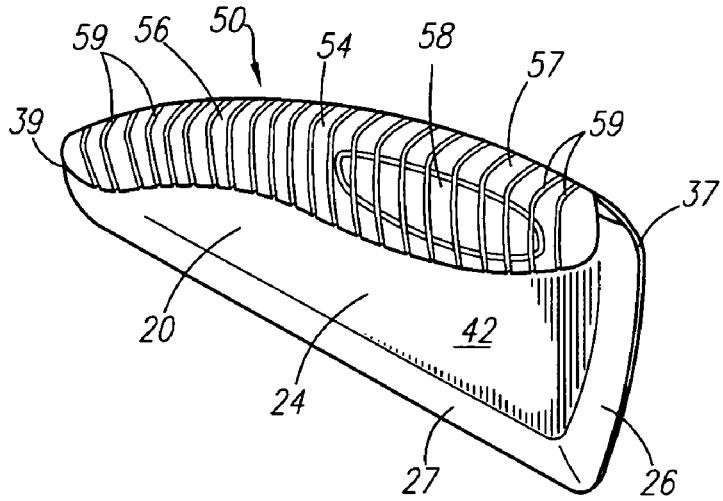
FIG. 2 is a right side perspective view of the cleaning implement, according to the preferred embodiment of the present invention.

With reference to FIGS. 1-6, a cleaning implement 10 is disclosed, according to one embodiment of the present invention, for engaging a surface to be cleaned and for removing unwanted material having accumulated onto the surface. The cleaning implement 10 comprises an elongated squeegee blade 20 preferably made of a lightweight, resiliently flexible plastic material such as an elastomer, which may be a polyolefin or a flexible polyvinyl chloride (PVC), a deformable plastic, natural rubber, synthetic rubber, polyurethane, neoprene, or a resiliently flexible thermoplastic such as vinyl or polypropylene.

The squeegee blade 20 comprises a first side 22 opposite a second side 24 and a lower blade edge 30 from which a leading curved blade edge 36 extends upwardly therefrom inclinationally at an angle of approximately 72°. More specifically, the lower blade edge 30 defines a forward curved blade edge 32 opposing a rear curved blade edge 34, and from the forward curved blade edge 32 upwardly extends the leading curved blade edge 36 inclinationally therefrom at an angle of approximately 72°. The leading curved blade edge 36 terminates upwardly into a curved pinnacle edge 37, the curved pinnacle edge 37 extending therefrom into an elongated curved upper edge 38. The elongated curved upper edge 38 terminates along a lower end 38*a* thereof into a trailing curved blade edge 39 which integrally joins rear curved blade edge 34.

The first side 22 and the second side 24 each comprise a first bevel 26 extending longitudinally and adjacent the leading curved blade edge 36 and a second bevel 27 extending horizontally above the lower blade edge 30. An uppermost edge of the first bevel 26, represented by longitudinal axis Y in FIG. 6., and the uppermost edge of the second bevel 27, represented by horizontal axis X in FIG. 6, terminate integrally into a syncline planar section 40, 42 formed on the first side 22 and the second side 24, respectively.

The first side 22 and the second side 24 each further comprise a gripping section 50 ergonomically configured to facilitate and enhance the grip of cleaning implement 10 by user. The gripping section 50 comprises a first gripping portion 52 formed integral with the first side 22 between the elongated curved upper edge 38 and the syncline planar section 40 of the first side 22. The first gripping portion 52 defines a curvilinear configuration extending from proximal the curved pinnacle edge 37 to the subordinate curved blade edge 39. The first gripping portion 52 includes a forward-area 53 from which a prolate-shaped bulbous region 54 integrally protrudes outwardly therefrom. The bulbous region 54 provides a gripping means around which user's fingers may firmly grasp, thereby enhancing user's grip of the cleaning implement 10.

The first gripping portion 52 further defines a plurality of spaced recesses 55 formed along a surface thereof, wherein the spaced recesses 55 each being vertically oriented. The spaced recesses 55 are adapted and configured to further enhance user's grip of the cleaning implement 10.

The gripping section 50 further comprises a second gripping portion 56 formed integral with the second side 24 between the elongated curved upper edge 38 and the syncline planar section 42 of the second side 24. The second gripping portion 56 defines a curvilinear configuration extending from proximal the curved pinnacle edge 37 to the subordinate curved blade edge 39. The second gripping portion 56 includes a forward area 57 from which a prolate-shaped bulbous region 58 integrally protrudes outwardly therefrom. The bulbous region 58 provides a gripping means around which user's fingers may firmly grasp, thereby enhancing user's grip of the cleaning implement 10.

The second gripping portion 56 further defines a plurality of spaced recesses 59 formed along a surface thereof, wherein the spaced recesses 59 each being vertically oriented. The spaced recesses 59 are adapted and configured to further enhance user's grip of the cleaning implement 10.

The first gripping portion 52 and the second gripping portion 56 may each be made of a resiliently flexible plastic material such as an elastomer, which may be a polyolefin or a flexible polyvinyl chloride (PVC), a deformable plastic, natural rubber, synthetic rubber, polyurethane, neoprene, foam materials including elastomeric or other deformable polymeric foams, or a resiliently flexible thermoplastic such as vinyl or polypropylene.

In use of the present invention, according to one embodiment thereof, as the lower blade edge 30 of the squeegee blade 20 is pressed against a surface, such as a plate or dish surface (not shown), the lower blade edge 30 may change shape slightly according to a contour of the plate surface in view of the lower blade edge's 30 inherent deformability such that the contours of the plate surface can be followed intimately by the lower blade edge 30 to provide exceptional cleaning.

Figure 3:
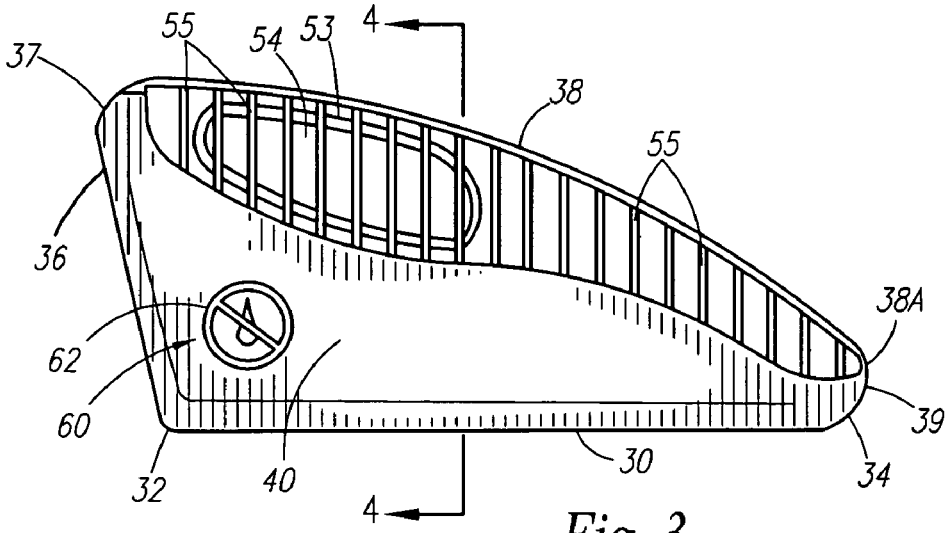
FIG. 3 is a left side elevational view of the cleaning implement of FIG. 1.
Figure 4:
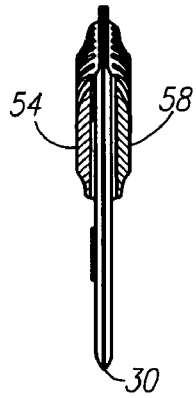
FIG. 4 is a cross-sectional view of the cleaning implement taken along lines 4-4 of FIG. 3.
Figure 5:
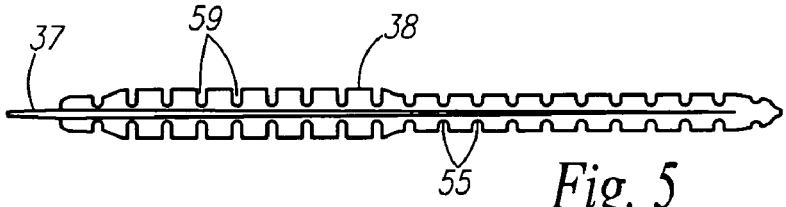
FIG. 5 is a top plan view of the cleaning implement of FIG. 1.
Figure 6:
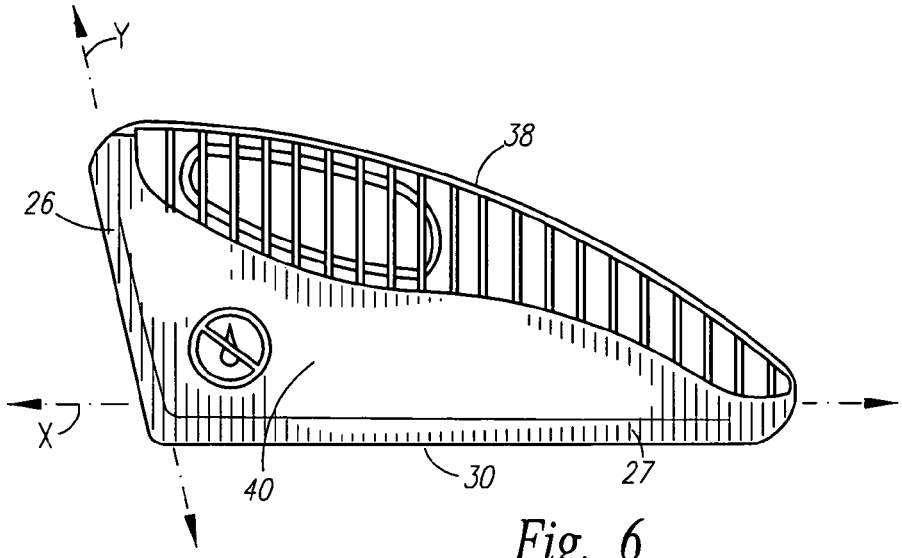
FIG. 6 is a left side elevational view of the cleaning implement of FIG. 1 illustrating uppermost edges of each the first bevel and the second bevel.

The cleaning implement 10 is envisioned to be manufactured in any number of desired color choices. In addition, the cleaning implement 10 may be provided with ornamentation or indicia 60 in the form of a company or corporate name, logo 62, wording, picture, photograph, or any other decorative, informational, promotional or advertisement indicia. FIG. 3 illustrates a logo 62 disposed along the syncline planar section 40 of the first side 22 of the squeegee blade 20.

Figure 7A:
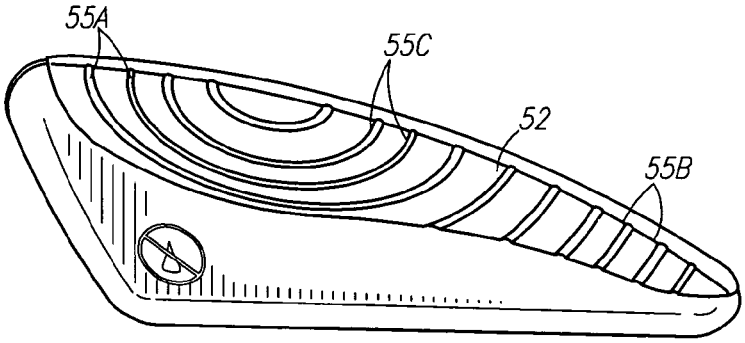
FIGS. 7A-7B illustrate alternate embodiments of the present invention.
Figure 7B:
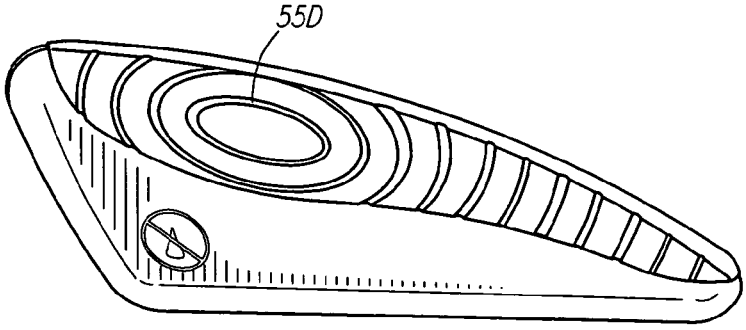

Finally, FIGS. 7A-7B illustrate alternate embodiments of the present invention, wherein the first gripping portion 52 includes spaced recesses 55*a*, some of which being vertically oriented 55*b*, arcuate-shaped 55*c*, and oval-shaped 55*d*. While not shown, this particular embodiment is intended to include the second gripping portion 56 provided on the second side 24 of squeegee blade 20 with spaced recesses 55*a* corresponding in mirror-like fashion to spaced recesses 55*a*, 55*b*, 55*c*, and 55*d* as shown formed in the first gripping portion 52 of FIGS. 7A-7B.

The use of the present invention allows debris to be removed from surfaces without the use of water in a quick, easy, and efficient manner.

It is envisioned that the various embodiments, as separately disclosed, are interchangeable in various aspects, so that elements of one embodiment may be incorporated into one or more of the other embodiments, and that specific. positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A cleaning implement for removing debris from surfaces without the use of water, the cleaning implement comprising:

an elongated squeegee blade, the squeegee blade comprising:

a first side;

a second side opposing the first side; and a lower blade edge from which a leading curved blade edge extends upwardly therefrom inclinationally at an angle of approximately 72°, the leading curved blade edge terminates upwardly into a curved pinnacle edge, the curved pinnacle edge extending therefrom into an elongated curved upper edge, the elongated curved upper edge terminates along a lower end thereof into a trailing curved blade edge integrally joining the lower blade edge, wherein the lower blade edge defines a forward curved blade edge opposing a rear curved blade edge, and from the forward curved blade edge upwardly extends the leading curved blade edge inclinationally therefrom at an angle of approximately 72°, wherein the elongated curved upper edge terminates along the lower end thereof into the trailing curved blade edge which integrally joins the rear curved blade edge of the lower blade edge, and wherein the first side and the second side each comprises:

a first bevel extending longitudinally and adjacent the leading curved blade edge, the first bevel has an uppermost edge; and a second bevel extending horizontally above the lower blade edge, the second bevel has an uppermost edge, wherein the uppermost edge of the first bevel and the uppermost edge of the second bevel terminate integrally into a syncline planar section formed on the first side and the second side, respectively, wherein the first side and the second side each further comprise a gripping section ergonomically configured to facilitate and enhance a grip of the cleaning implement by a user, and wherein the gripping section comprises a first gripping portion formed integral with the first side between the elongated curved upper edge and the syncline planar section of the first side, the first gripping portion defines a curvilinear configuration extending from proximal the curved pinnacle edge to the subordinate curved blade edge, wherein the first gripping portion includes a forward area from which a prolate-shaped bulbous region integrally protrudes outwardly therefrom, the bulbous region provides a gripping means around which a user's fingers may firmly grasp, thereby enhancing the user's grip of the cleaning implement.

2. The cleaning implement of claim 1, wherein the gripping section further comprises a second gripping portion formed integral with the second side between the elongated curved upper edge and the syncline planar section of the second side, the second gripping portion defines a curvilinear configuration extending from proximal the curved pinnacle edge to the subordinate curved blade edge.

3. The cleaning implement of claim 2, wherein the second gripping portion includes a forward area from which a prolate-shaped bulbous region integrally protrudes outwardly therefrom, the bulbous region provides a gripping means around which a user's fingers may firmly grasp, thereby enhancing the user's grip of the cleaning implement.

4. The cleaning implement of claim 3, wherein second gripping portion further defines a plurality of spaced recesses formed along a surface thereof.

5. The cleaning implement of claim 4, wherein the spaced recesses are each vertically oriented, the spaced recesses are adapted and configured to further enhance the user's grip of the cleaning implement.

6. The cleaning implement of claim 1, wherein the first gripping portion further defines a plurality of spaced recesses formed along a surface thereof.

7. The cleaning implement of claim 6, wherein the spaced recesses are each vertically oriented, the spaced recesses are adapted and configured to further enhance the user's grip of the cleaning implement.

8. The cleaning implement of claim 1, wherein the lower blade edge is inherently deformable such that when the lower blade edge is pressed against a surface, the lower blade edge changes shape slightly according to a contour of the surface, thereby allowing the contours of the surface to be followed intimately by the lower blade edge.

9. The cleaning implement of claim 1, wherein the squeegee blade is constructed of a lightweight, resiliently flexible plastic material.

10. The cleaning implement of claim 1, wherein the gripping section is constructed of a resiliently flexible plastic material.

11. The cleaning implement of claim 1, wherein the squeegee blade is manufactured so as to be available in any number of colors.

12. The cleaning implement of claim 1, wherein the squeegee blade is provided with ornamentation and/or indicia.

13. The cleaning implement of claim 1, wherein the gripping section includes spaced recesses formed therein, the spaced recesses being arcuate-shaped or oval-shaped.

* * * * *